US007296383B2

(12) United States Patent
Schiedegger et al.

(10) Patent No.: US 7,296,383 B2
(45) Date of Patent: Nov. 20, 2007

(54) PLASTIC BATTEN SHUTTER

(75) Inventors: Charles E Schiedegger, Metamora, MI (US); Dean Dennis, Lapeer, MI (US)

(73) Assignee: Tapco International, Wixom, MI (US)

( * ) Notice: Subject to any disclaimer, the term of this patent is extended or adjusted under 35 U.S.C. 154(b) by 260 days.

(21) Appl. No.: 11/072,874

(22) Filed: Mar. 4, 2005

(65) Prior Publication Data

US 2005/0166492 A1 Aug. 4, 2005

Related U.S. Application Data

(63) Continuation of application No. 10/456,439, filed on Jun. 6, 2003, now Pat. No. 6,968,656.

(60) Provisional application No. 60/392,320, filed on Jun. 27, 2002.

(51) Int. Cl.
*E06B 3/26* (2006.01)

(52) U.S. Cl. ..... 52/202; 52/203; 52/473; 52/782.1; 52/801.1; 52/801.12; 52/475.1; 52/211; D25/47; D25/50; D25/52; 108/901; 108/902; 108/51.11

(58) Field of Classification Search ..... 52/202, 52/473, 475.1, 177, 716.8, 718.04, 483.1, 52/782.1, 801.1, 801.11, 801.12; 256/73; 15/238; D25/47, 50, 52; 108/901, 902, 108/51.11
See application file for complete search history.

(56) References Cited

U.S. PATENT DOCUMENTS 2,948,956 A * 8/1960 Colombini ..... 29/411
3,628,298 A * 12/1971 Sickler ..... 52/473
4,546,585 A * 10/1985 Governale ..... 52/309.11
5,758,456 A * 6/1998 Case ..... 52/177
6,214,428 B1 * 4/2001 Henderson ..... 428/54

* cited by examiner

*Primary Examiner*—Jeanette Chapman
*Assistant Examiner*—Dan Kenny
(74) *Attorney, Agent, or Firm*—Howard & Howard Attorneys, P.C.

(57) ABSTRACT

A decorative shutter assembly includes a plurality of slats or boards arranged in a row presenting a decorative surface with side flanges projecting rearwardly. At least one cross member overlays each of the slats and presents a decorative cross surface with side cross flanges projecting rearwardly. Each cross slat includes at least one mating member affixed behind the cross slat decorative surface having a mating wall affixed to each of the decorative surfaces for affixing the plurality batten slats to the cross slat. Alternatively, a plurality of primary slats are arranged to present a decorative surface having side flanges projecting rearwardly and at least one end piece is attached to the primary slats the ends of the primary slats are received in the end piece for adjoining and aligning said primary slats, said end piece including a cross member traversing said the primary and having slats and slat ends integrated into the end piece, each of said slats and slat ends aligning with one of the primary slats.

26 Claims, 6 Drawing Sheets

PLASTIC BATTEN SHUTTER

CROSS-REFERENCE TO RELATED APPLICATIONS

This application is continuation of U.S. application Ser. No. 10/456,439, filed Jun. 6, 2003, which claims the benefit of U.S. Provisional Patent Application Ser. No. 60/392,320, filed Jun. 27, 2002, now U.S. Pat. No. 6,968,656.

BACKGROUND OF THE INVENTION

The present invention relates to a decorative building shutter for mounting on a wall surface. More specifically, the present invention relates to an improved plastic batten shutter.

Decorative building panels, such as shutters, are widely used in the building industry to add character to a house or other type of building structure. Additionally, decorative building panels are frequently installed on existing structures to change the appearance of the structure. A popular type of building panel that is used is a window shutter. These shutters, which are typically not functional, present a decorative facade that gives the appearance of being a functional shutter.

One popular style of shutter is commonly referred to as a batten shutter. The batten shutter includes a plurality of batten slats or boards arranged vertically in a row. At least one, and usually two, cross slats overlay each of the batten slats. The cross slats adjoin the batten slats forming the batten shutter assembly. A simulated plastic batten shutter commonly includes slats having a decorative surface and flanges projecting rearward from the surface creating a hollow slat that gives the appearance of being a complete wooden slat. While the plastic materials reduce the cost of producing the batten shutter, connecting the slats together is a labor intensive and costly operation.

One such example is U.S. Pat. No. 4,184,300 to Deschamps. Deschamps discloses a batten shutter having plastic batten slats with decorative surface and side flanges. Each batten slat is affixed to a cross slat with pin. Utilizing pins to connect the batten slats to the cross slats adds cost and assembly time due to the increased number of parts required for assembly.

Therefore, it would be desirable to provide a batten shutter that is simple to produce and yet presents the appearance of being assembled from real wood.

SUMMARY OF THE INVENTION AND ADVANTAGES

The present invention discloses a decorative shutter assembly having a plurality of batten slats arranged in a row and connected together by at least one cross slat. Each batten slat presents a batten decorative surface having side batten flanges projecting rearward. Each cross slat overlays the batten slats and presents a decorative cross surface with side cross flanges projecting rearward. Each cross slat includes at least one mating member affixed behind the cross-decorative surface with a mating wall affixed to each of the batten decorative surfaces. The slats are affixed to the mating member by sonic welding or heat welding. Each of the slats includes end plugs at each end to present a finished appearance of being a complete wooden board.

The inventive batten shutter provides a simple design that is easily produced and presents the appearance of being made from wooden boards. The mating member maximizes the amount of extrusion processing that can be utilized enabling a single extruder to be used for both the cross slats and the batten slats by providing a mating surface to the batten slats. Further, hiding the mating surface behind the cross slat provides the ability to form an attachment point from either a sonic weld or a heat weld.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
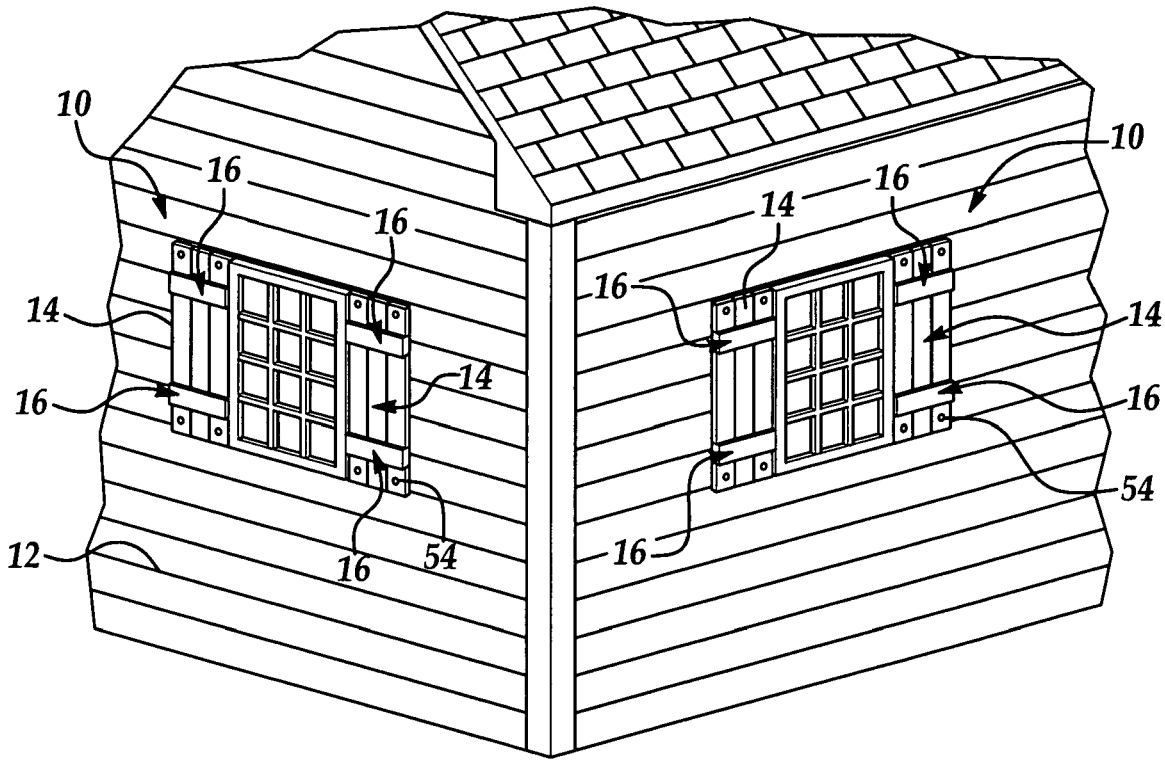
FIG. 1 is an environmental view of the batten shutter of the subject invention.

With reference to the Figures, wherein like numerals indicate like or corresponding parts, a decorative trim assembly, generally shown at 10, is mounted on a structure 12. The assembly 10 includes at least one first member 14, at least one transverse member, generally indicated at 16, and a mating member, generally indicated at 18.

The first member 14, such as a main slat or plurality of main slats, is disposed on the structure 12 and includes a first front plane 20, or decorative surface, and at least one side wall 22 extending rearwardly from the plane 20. The first member 14 includes a first portion 24 and a second portion 26. The second portion 26 and the first portion 24, may be separated by a seam 28, shown in dotted lines (see below).

Figure 6A:
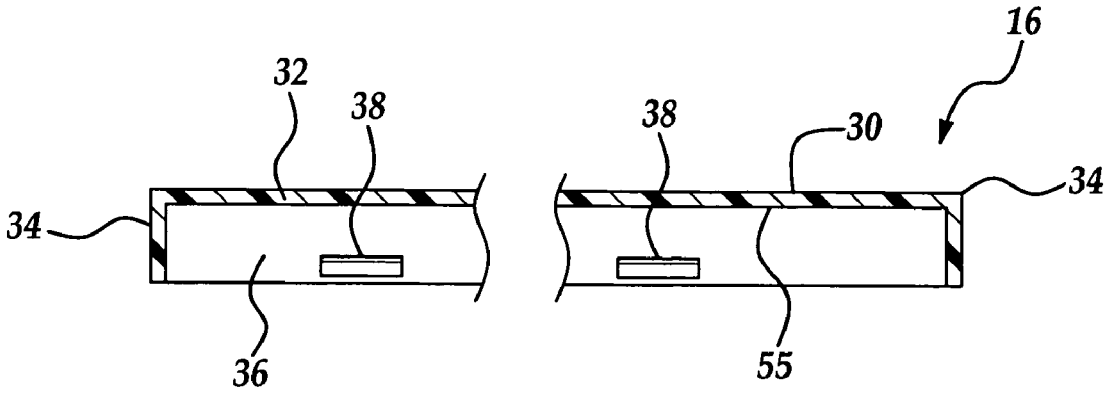
FIG. 6A is a first cross-sectional view of a top cover of a batten slat of the batten shutter of FIG. 2.

The transverse member 16 is disposed on the first member 14 and presents a second front plane 50, or decorative surface, having a pair of opposing sides 32 and a pair of opposing ends 34. Each opposing side 32 presents a side flange 36 extending rearwardly from the side 32 and having a locking mechanism 38 disposed on the side flange 36 (see FIGS. 6A and 6B). The locking mechanism 38 may be a tab or any other suitable locking mechanism.

Each opposing end 34 presents an end flange 40 extending rearwardly from the end 34 and covering a portion of the side wall 22. More particularly, the end flange 40 may be adapted to cover the seam 28 (if present) between the first 24 and second 26 portions of the first member 14 to create an aesthetically pleasing appearance.

The mating member 18 is disposed behind the second front plane 30 for removably engaging the transverse member 16. The mating member 18 includes a first notch 42 and a second notch 44. The first notch 42 corresponds to the locking mechanism 38 and is adapted to receive the locking mechanism 38 for removably engaging the locking mechanism 38 in locking engagement. The second notch 44 corresponds to the locking mechanism 38 and is adapted to receive the locking mechanism 38 for removably engaging the locking mechanism 38 in slidable engagement.

The mating member 18 includes a plurality of regularly repeating reinforced structural sections 46. Each of the plurality of regularly repeating reinforced structural sections 46 includes a planar portion 48 integrally formed with and bounded on both ends by reinforcement ribs 50. The planar portion 48 defines a plurality of apertures 52 therein for mounting the mating member 18 to the transverse member 16 and allowing the planar portion 48 to be removed from the decorative surface 20.

In a first embodiment, the mating member 18 is affixed to the first member 14 by a plurality of sonic welds. In a second embodiment, the mating member 18 is affixed to the first member 14 by a plurality of heat welds.

As shown in the figures, the assembly 10 is a shutter assembly wherein the first member includes at least one slat, such as a batten slat, and the transverse member includes at least one cross slat.

In the illustrated embodiment, a plurality of first members or batten slats 14 are arranged in a row and at least one transverse member or cross slat 16 overlays each of the batten slats 14. FIG. 1 shows the assembly 10 having two cross slats 16. The assembly 10 is mounted to the structure 12 via a fastener 54. Any type of fastener 54 will suffice to affix the mating member to the first and transverse members, including screws, shutter locks, and the like. The batten slats 16 include the first front plane or batten decorative surface 20 and the cross slat 16 includes the second front plane or cross-decorative surface 30.

Each batten slat 14 includes the side flanges 36 projecting rearward from opposing sides 32 of the batten decorative surface 20 running the length of the batten slat 14. Each cross slat 16 includes the end flanges 40 projecting rearward from the opposing ends 34 of the cross decorative surface 30 running the length of the cross slat 16.

Each of the slats 14, 16 is preferably formed through a plastic extrusion process from polypropylene or a like material. Additionally, the material can be formed in a variety of colors including ultra violet (UV) adsorbents to prevent fading and warping due to UV damage as is commonly practiced in the art of composite building components.

Figure 2:
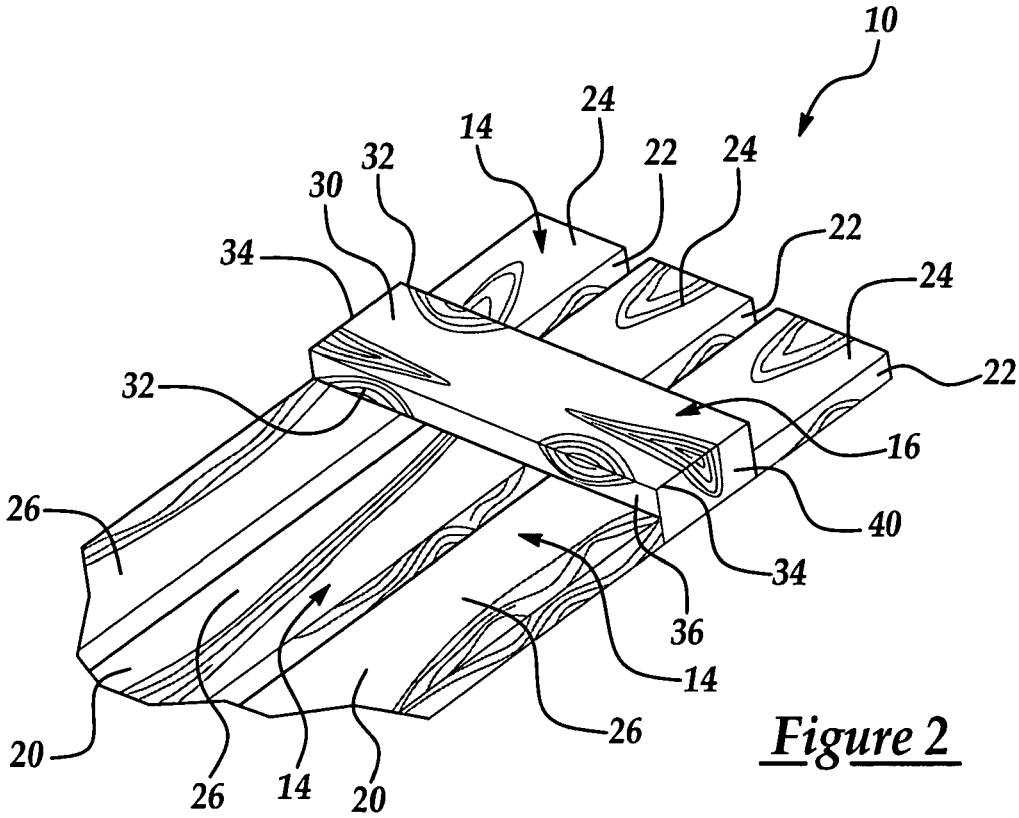
FIG. 2 is a front fragmentary view of the batten shutter of FIG. 1.

Each cross slat 16 includes at least one mating member 18 affixed behind the cross-decorative surface 30 to a rear cross surface 55. The mating member 18 forms a shell having a planar portion or mating wall 48 and base wall 56. The base wall 56 is affixed to the rear cross surface 55 of the cross slat 16 and the mating wall 48 is affixed to each of the batten decorative surfaces 20 thereby affixing the plurality batten slats 14 to at least one cross slat 16. In one embodiment, the assembly 10 will include one less mating member 18 than the number of batten slats 14. Thus, each mating member 18 will straddle adjacent batten slats 14 as is best represented in FIG. 2.

Each mating member 18 is affixed to the cross slat 16 and to the batten slats 14 by the plurality of apertures or mating attachment points 52. The attachment points 52 may comprise sonic welds. Alternatively, the attachment points 52 comprise heat welds. Generally, sonic welds will be utilized when making an attachment point 52 to a visible decorative surface 20, 30.

It should be noted that the decorative shutter assembly may have any number of batten slats 14, e.g., four. Each cross slat 16 includes the mating member 18 and the first front plane 20.

The batten slats 14 include the batten decorative surface 20. Each batten slat 14 also includes two side flanges 36 and two end flanges 40. The two side flanges 36 and the two end flanges 40 define an batten interior volume on an opposite side of the batten decorative surface 20.

In one embodiment, the batten slats 14 are manufactured in predetermined lengths, e.g., 60 inches. In order to assembly a shutter assembly 10 having an overall length other than 60 inches, one or more batten slats 14 may be cut such that their combines length equals the desired length. As discussed below, the end flange(s) 40 of the cross slat(s) 16 may be used to hide the seam 28 or joint between the two batten slats 14.

Figure 3:
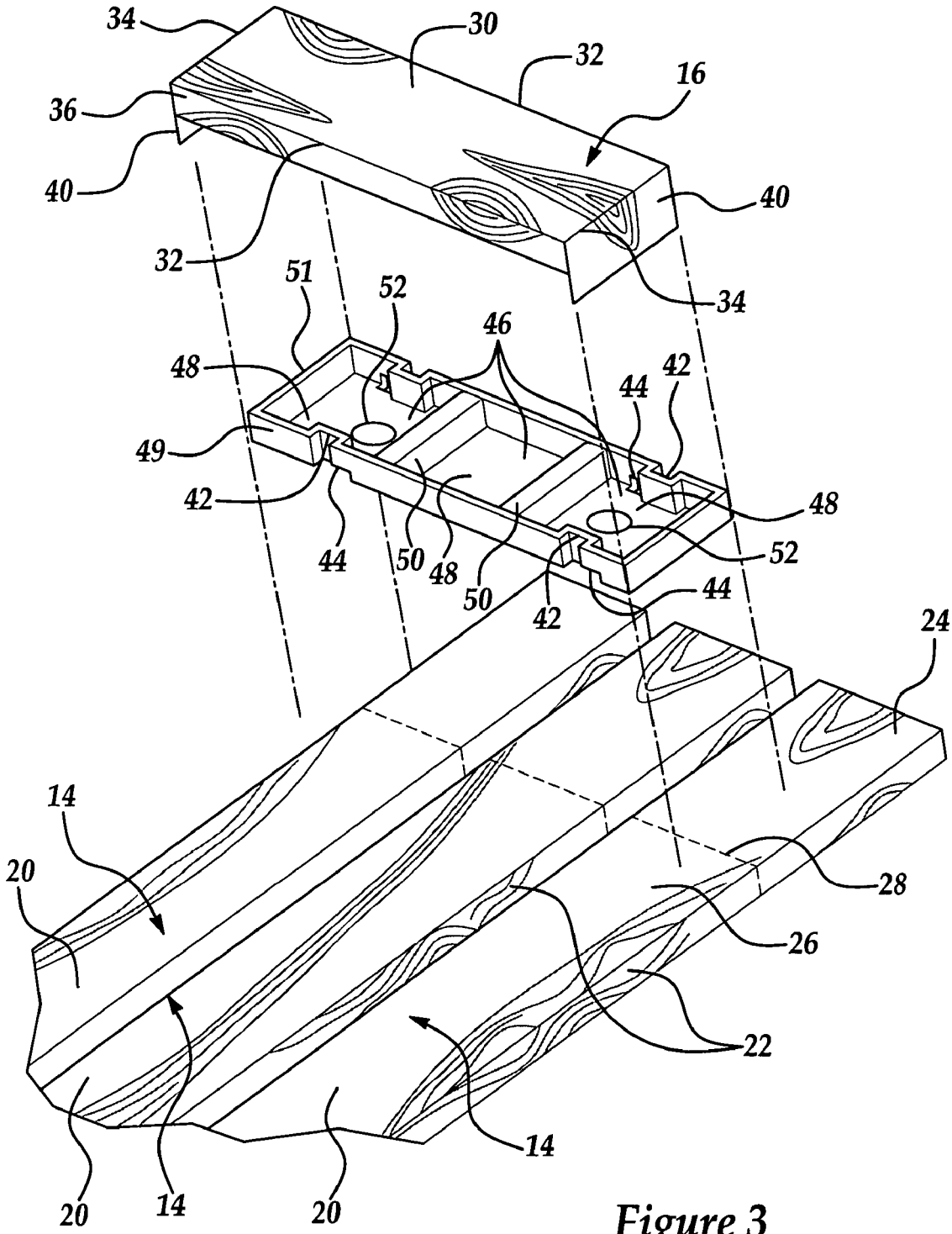
FIG. 3 is an exploded view of the batten shutter of FIG. 2.
Figure 4A:
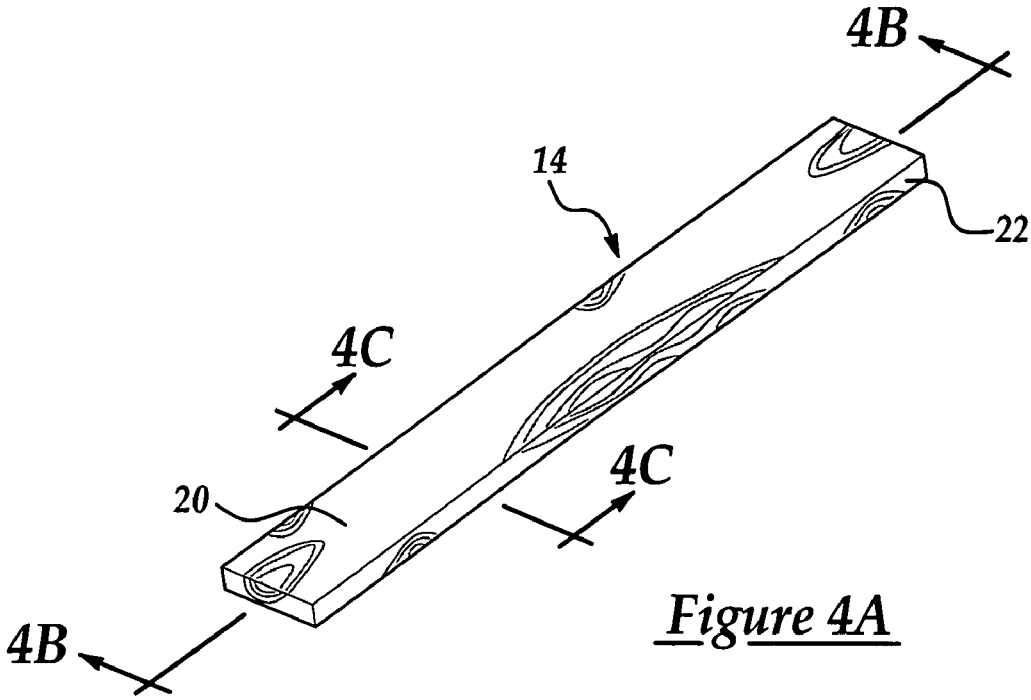
FIG. 4A is a perspective view of a batten slat of the batten shutter of FIG. 2, according to an embodiment of the present invention.
Figure 4B:
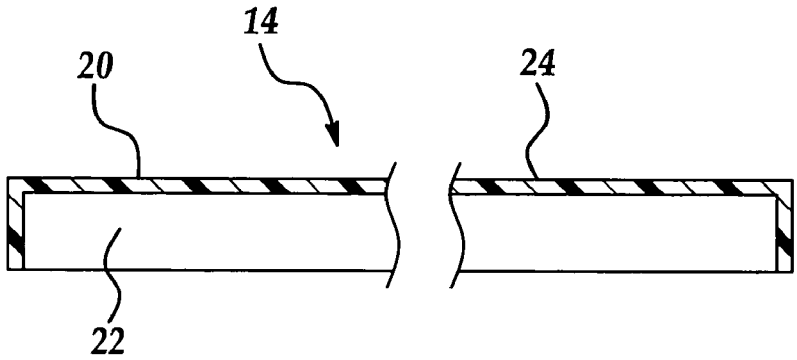
FIG. 4B is a first cross-sectional view of the batten slat of the batten shutter of FIG. 4A.
Figure 4C:
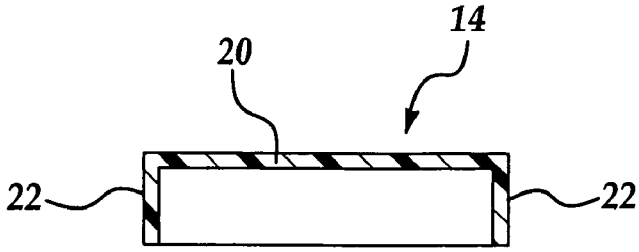
FIG. 4C is a second cross-sectional view of the batten slat of the batten shutter of FIG. 4A.
Figure 5A:
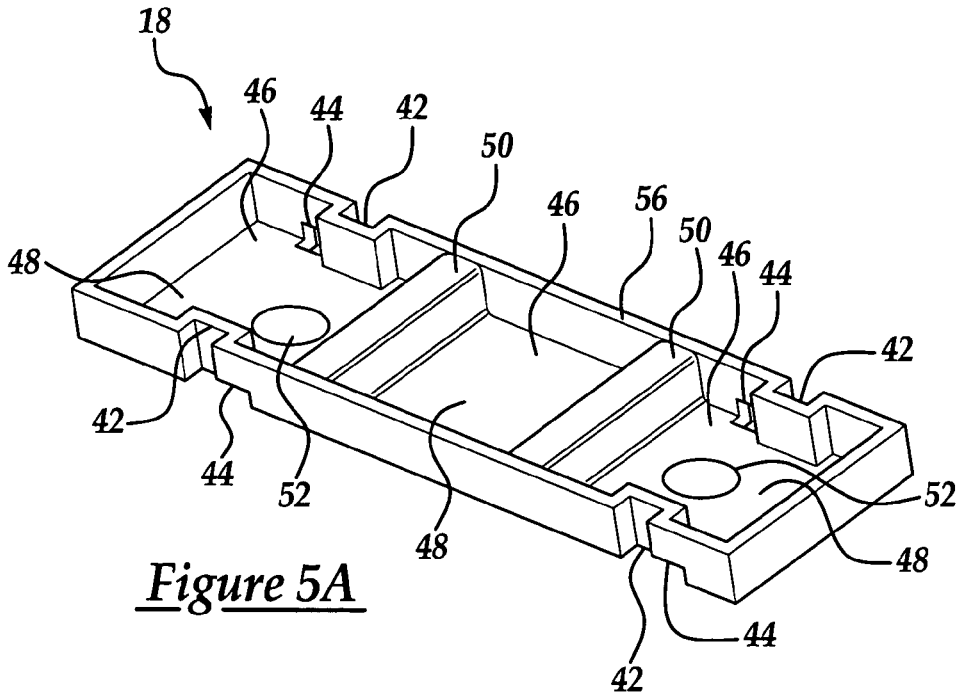
FIG. 5A is a perspective view of a mating member of a cross slat of the batten shutter of FIG. 2, according to a first embodiment.
Figure 5B:
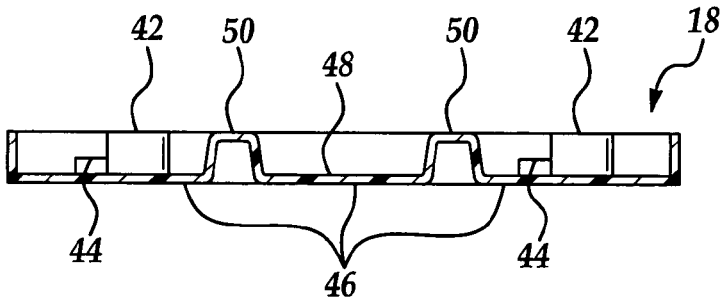
FIG. 5B is a first cross-sectional view of the mating member of FIG. 5A.
Figure 5C:
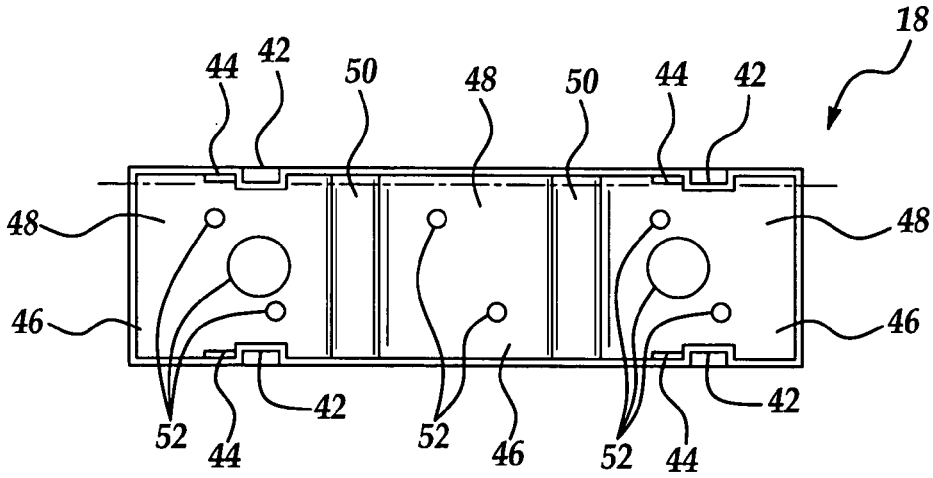
FIG. 5C is a bottom view of the mating member of FIG. 5A.

Each mating member 18 includes a plurality of regularly repeating reinforced structural sections 46. The number of sections 46 correspond directly to the number of batten slats 14 in the assembled shutter assembly 10. For example, the mating member 18 includes three sections 46 corresponding to the three slats 14 shown in FIGS. 2 and 3. Each mating member 18 includes the regularly repeating reinforced structural sections 46 and the ribs 50 formed with and rising from the planar portion or back wall 48. The sections 46 are formed by mating member side flanges 49, mating member end flanges 51, plurality of ribs 50 and the back wall 48.

The back wall 48 includes at least one large aperture 52. The back wall 48 also includes at least two smaller apertures 53 in each section 46. The large aperture 52 is used to assist in separating the first front plane or top cover 20 and the mating member 18.

To assemble the shutter assembly 10, the mating members 18 are affixed to the batten slats 14 by a suitable process, such as sonic welding, heat welds, or by using a suitable fastener such as a clip, a screw, or the like. The smaller apertures 53 may be formed during the fastening process.

The top cover 30 of the cross slat 16 includes the cross decorative surface 30, two side flanges 36 and two end flanges 40. The two side flanges 36 and the two end flanges 40 define a cross batten interior volume.

In one embodiment, the cross slats 16 includes the locking mechanism 38 which is used to removably lock the top cover 20 to its corresponding mating member 18 when the decorative shutter assembly 10 is assembled The top cover 20 and the corresponding mating member 18 may also be assembled in a non-locking position pre-assembly, e.g., during shipping (see below).

The locking mechanism 38 includes the first notch 42 and second notch 44 located on an interior surface of each side flanges 36. In the illustrated embodiment, the notches 42, 44 are located on each side flange 36. Each notch 42, 44 is directly across from the corresponding locking mechanism or tab 38 on the inner surface of the opposing side flange 36.

Figure 6B:
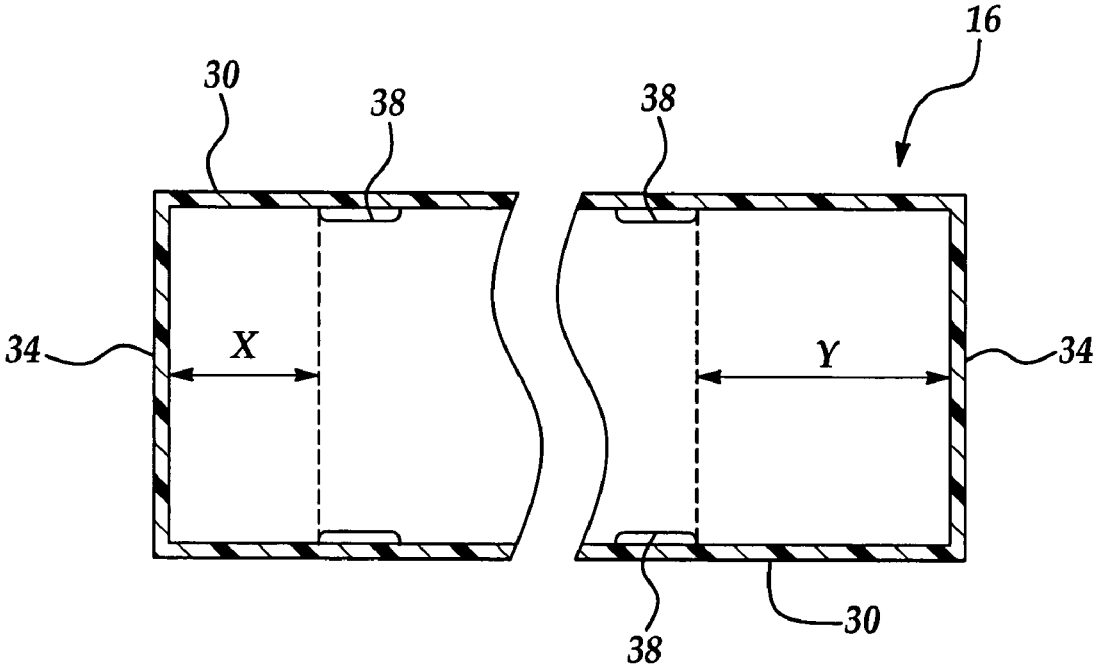
FIG. 6B is a second cross-sectional view of the top cover of FIG. 6A.

Each tab 38 is offset from the end flange 40 by a predetermined distance. For example, the tabs 38 on the left in FIGS. 6B and 6B are offset from the end flange 40 by a distance of "X". The tabs 38 in the right in FIGS. 6B and 6B are offset from the end flange 40 by a distance if "Y". X and Y are not equal.

Figure 7A:
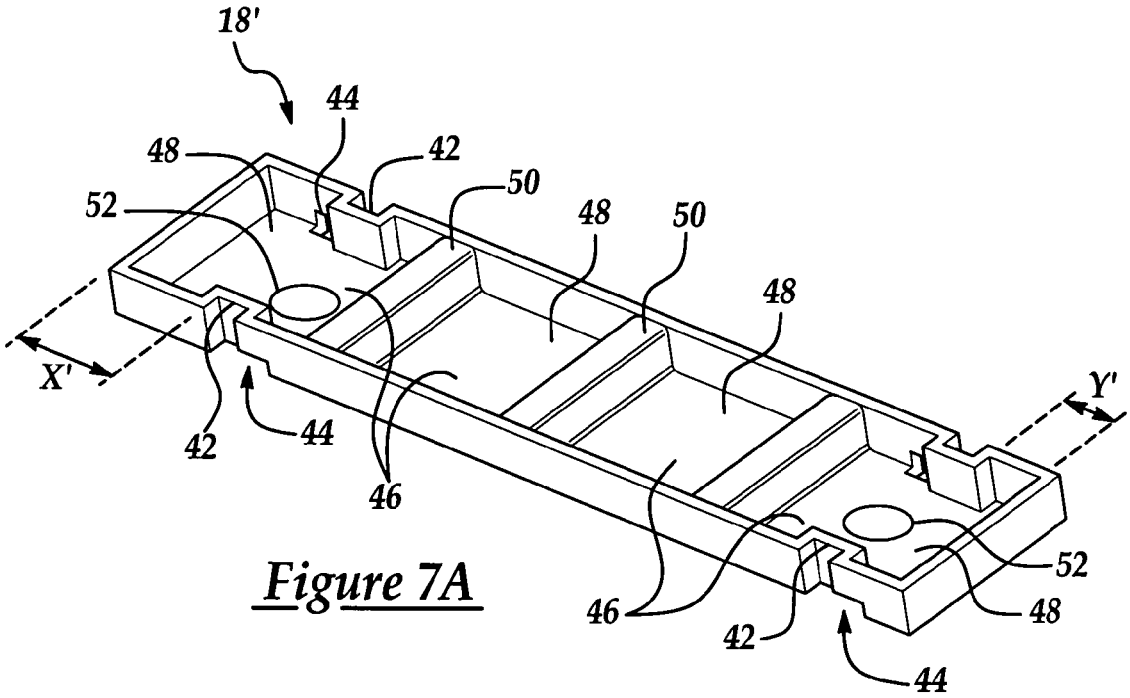
FIG. 7A is a perspective view of a mating member of the cross slat of a batten shutter according to another embodiment.
Figure 7B:
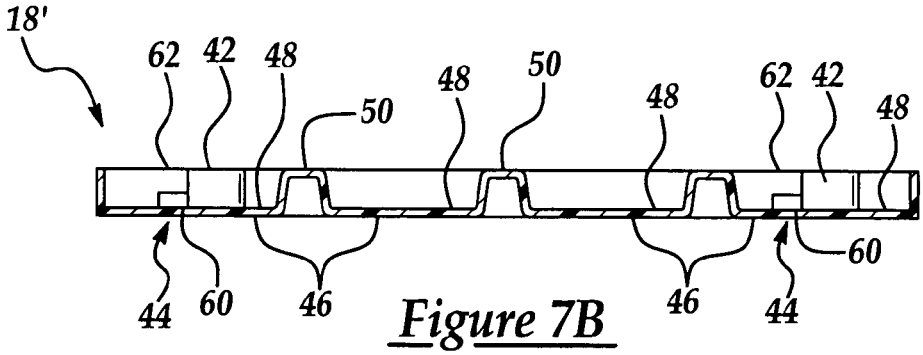
FIG. 7B is a first cross-sectional view of the mating member of FIG. 7A.
Figure 7C:
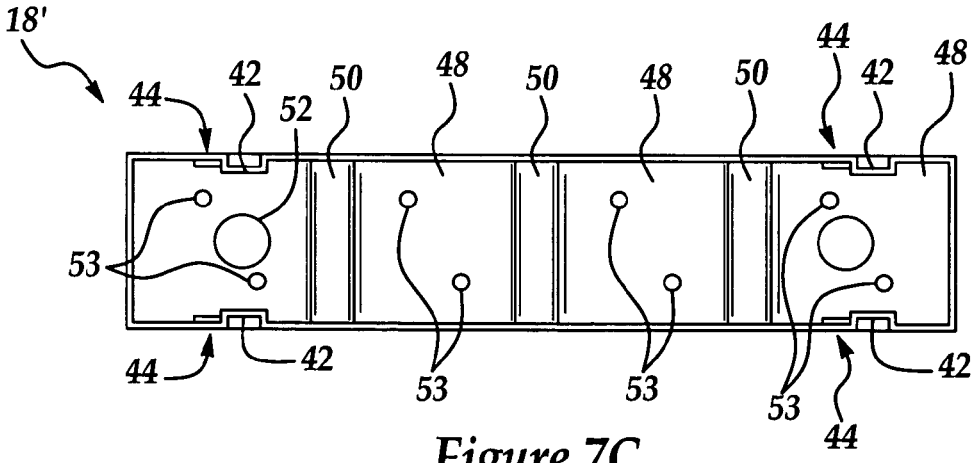
FIG. 7C is a bottom view of the mating member of FIG. 7A.

Each mating member 18 includes the second notch 44 corresponding to each tab 38. Each notch 44 includes a channel portion 60 and a locking portion 62 (see FIG. 7B). The locking portions 62 are adjacent the corresponding channel portion 60. The locking portions 62 are offset from a respective mating member end flange 40 by a distance of X', Y'. X'and Y' are not equal.

As discussed above, the top cover 30 of each cross slat 16 may be assembled with the mating member 18 in either a locking position or a slidably removable position. In the illustrated embodiment, the locking position is defined when one of the side flanges 36 is oriented with a predetermined one of the mating member side flanges 49. The slidably removable position is defined when the top cover 20 is assembled 180 degrees from the locking position.

When the top cover 30 and the mating member 18 are assembled in the slidably removable or non-locking position, each tab 38 is maintained within a respective channel portion 60. Thus, the top cover 20 is able to slide from on and off.

When the top cover 32 and the mating member 18' are assembled in the locked position, each tab 38 is aligned with a corresponding locking portion 60. When fully assembled each tab 38 is maintained in position by the corresponding locking portion 60, and thus, the top cover 20 and the mating member 18 are "locked". It should be noted that although the top cover 20 and the mating member 18 are locked, the top cover 20 may be removed from the mating member 18 by flexing the side flanges 36 such that the tabs 38 are disengaged from the locking portions 60.

In an alternative embodiment, a cross slat 14 includes a top cover 20 and a mating member 18' for use in a shutter assembly having four batten slats or boards.

If the shutter assembly 10 length must be composed of portions of one or more batten slats 14, the seam is hidden by the cross slat 16. Furthermore, the cross slat end flanges extend past the side flanges 36 to cover the seam 28 in the side flanges 14.

The invention has been described in an illustrative manner, and it is to be understood that the terminology that has been used is intended to be in the nature of words of description rather than of limitation. Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. A batten shutter, comprising:

a plurality of main slats, each main slat having a front surface and first and second side walls extending from opposite edges of the front surface; and a transverse member coupled to the main slats, the transverse member generally extending across the main slats from the first side wall of a first one of the main slats to the second side wall of a last one of the main slats, the transverse member having a second front surface and first and second side flanges extending from opposite edges of the second front surface, the first side flange extending from the second front surface to cover a major portion of the first side wall of the first one of the main slats and the second side flange extending from the second front surface to cover a major portion of the second side wall of one of the first and second side walls of the main slat;

wherein the last one of the main slats includes a first portion and a second portion disposed on said first portion with a seam juxtaposed between the first and second portions.

2. The invention in accordance with claim 1, further comprising a mating member connected to the main slats, the transverse member being removably coupled to the mating member.

3. The invention in accordance with claim 1, wherein the first one of the main slats includes a first portion and a second portion disposed on said first portion with a seam juxtaposed between the first and second portions.

4. The invention in accordance with claim 3, wherein the first side flange covers the seam on the first side wall of the first main slat.

5. The invention in accordance with claim 1, wherein the second side flange covers the seam on the second side wall of the first main slat.

6. A batten shutter, comprising:

a plurality of main slats, each main slat having a front surface and first and second side walls extending from opposite edges of the front surface;

a transverse member coupled to the main slats, the transverse member generally extending across the main slats from the first side wall of a first one of the main slats to the second side wall of a last one of the main slats, the transverse member having a second front surface and first and second side flanges extending from opposite edges of the second front surface, the first side flange extending from the second front surface to cover at least a portion of the first side wall of the first one of the main slats and the second side flange extending from the second front surface to cover at least a portion of the second side wall of one of the first and second side walls of the main slat; and a mating member connected to the main slats, the transverse member being removably coupled to the mating member.

7. The invention in accordance with claim 6, wherein the first one of the main slats includes a first portion and a second portion disposed on said first portion with a seam juxtaposed between the first and second portions.

8. The invention in accordance with claim 7, wherein the first side flange covers the seam on the first side wall of the first main slat.

9. The invention in accordance with claim 6, wherein the last one of the main slats includes a first portion and a second portion disposed on said first portion with a seam juxtaposed between the first and second portions.

10. The invention in accordance with claim 9, wherein the second side flange covers the seam on the second side wall of the first main slat.

11. A batten shutter, comprising:

a plurality of main slats, each main slat having a front surface and first and second side walls extending from opposite edges of the front surface;

a transverse member coupled to the main slats, the transverse member generally extending across the main slats from the first side wall of a first one of the main slats to the second side wall of a last one of the main slats, the transverse member having a second front surface and first and second substantially planar side flanges extending from opposite edges of the second front surface; and a mating member connected to the main slats, the transverse member being removably coupled to the mating member.

12. The invention in accordance with claim 11, wherein the first side flange extends from the second front surface to cover at least a portion of the first side wall of the first one of the main slats and the second side flange extends from the second front surface to cover at least a portion of the second side wall of one of the first and second side walls of the main slat.

13. The invention in accordance with claim 11, wherein the first one of the main slats includes a first portion and a second portion disposed on said first portion with a seam juxtaposed between the first and second portions.

14. The invention in accordance with claim 13, wherein the first side flange covers the seam on the first side wall of the first main slat.

15. The invention in accordance with claim 11, wherein the last one of the main slats includes a first portion and a second portion disposed on said first portion with a seam juxtaposed between the first and second portions.

16. The invention in accordance with claim 15, wherein the second side flange covers the seam on the second side wall of the first main slat.

17. A batten shutter, comprising:

a plurality of main slats, each main slat having a front surface and first and second side walls extending from opposite edges of the front surface;

a transverse member coupled to the main slats, the transverse member generally extending across the main slats from the first side wall of a first one of the main slats to the second side wall of a last one of the main slats, the transverse member having a second front surface and first and second side flanges extending from opposite edges of the second front surface, the first side flange extending from the second front surface to cover a major portion of the first side wall of the first one of the main slats and the second side flange extending from the second front surface to cover a major portion of the second side wall of one of the first and second side walls of the main slat; and a mating member connected to the main slats, the transverse member being removably coupled to the mating member.

18. The invention in accordance with claim 17, wherein the first one of the main slats includes a first portion and a second portion disposed on said first portion with a seam juxtaposed between the first and second portions.

19. The invention in accordance with claim 18, wherein the first side flange covers the seam on the first side wall of the first main slat.

20. The invention in accordance with claim 17, wherein the last one of the main slats includes a first portion and a second portion disposed on said first portion with a seam juxtaposed between the first and second portions.

21. The invention in accordance with claim 20, wherein the second side flange covers the seam on the second side wall of the first main slat.

22. A batten shutter, comprising:

a plurality of main slats, each main slat having a front surface and first and second side walls extending from opposite edges of the front surface; and a transverse member coupled to the main slats, the transverse member generally extending across the main slats from the first side wall of a first one of the main slats to the second side wall of a last one of the main slats, the transverse member having a second front surface and first and second side flanges extending from opposite edges of the second front surface, the first side flange extending from the second front surface to cover a major portion of the first side wall of the first one of the main slats and the second side flange extending from the second front surface to cover a major portion of the second side wall of one of the first and second side walls of the main slat;

wherein the first one of the main slats includes a first portion and a second portion disposed on said first portion with a seam juxtaposed between the first and second portions.

23. The invention in accordance with claim 22, further comprising a mating member connected to the main slats, the transverse member being removably coupled to the mating member.

24. The invention in accordance with claim 22, wherein the first side flange covers the seam on the first side wall of the first main slat.

25. The invention in accordance with claim 22, wherein the last one of the main slats includes a first portion and a second portion disposed on said first portion with a seam juxtaposed between the first and second portions.

26. The invention in accordance with claim 25, wherein the second side flange covers the seam on the second side wall of the first main slat.

* * * * *